United States Patent [19]

Janik

[11] 4,254,569

[45] Mar. 10, 1981

[54] BULLETIN DISPLAY BOARD

[76] Inventor: Carl L. Janik, P.O. Box 731, Sedona, Ariz. 86336

[21] Appl. No.: 959,854

[22] Filed: Nov. 13, 1978

[51] Int. Cl.[3] ..... G09F 15/00

[52] U.S. Cl. ..... 40/606; 40/610

[58] Field of Search ..... 40/152, 152.1, 156, 40/611, 606; 248/488

[56] References Cited

U.S. PATENT DOCUMENTS

| | | | |
|---|---|---|---|
| 1,914,068 | 6/1933 | Birnn | 40/152.1 |
| 2,979,842 | 4/1961 | De Ridder | 40/156 |
| 3,146,502 | 9/1964 | Reiss et al. | 40/156 |
| 3,220,132 | 11/1965 | Swiger et al. | 40/152.1 |
| 3,611,604 | 10/1971 | Saltzman | 40/152 |
| 4,133,123 | 1/1979 | Anderson | 40/611 |

*Primary Examiner*—Gene Mancene
*Assistant Examiner*—Wenceslao J. Contreras
*Attorney, Agent, or Firm*—Alfred E. Miller

[57] ABSTRACT

A bulletin display board in which messages and bulletins are held therein by means of a transparency and releasable clips. The board is arranged to be pivotable from a vertical to a horizontal position, the latter being for ease of insertion and removal of messages from the display board. The board further is provided with magnetic means to retain the same in a vertical position, when it is so required.

7 Claims, 5 Drawing Figures

BULLETIN DISPLAY BOARD

The present invention relates to bulletin display boards and more particularly to an improved display board which requires no special means for fixing each message card or bulletin to the board.

BACKGROUND OF THE INVENTION

Bulletin display boards are known, however, there are many drawbacks with respect to billboards presently being offered on the market. Perhaps the most serious of the drawbacks relating to known bulletin display boards is the necessity of attaching each message card or bulletin to the board individually with thumb tacks, nails, glue or tape. This is time consuming and often damages or destroys the message cards so that they cannot be used again. Furthermore, the various message cards or bulletins can be either maliciously or inadvertently removed or destroyed. A further difficulty of the known method of applying bulletins or messages to bulletin boards is the lack of provision for maintaining the messages or bulletins up-to-date, or for the orderly removal of bulletins or messages that have become outdated, or not appropriate.

It is an object of the present invention to overcome the drawbacks of the known methods of displaying bulletins and messages on bulletin boards, and to overcome the tedious, time consuming and costly results of the use of known types of bulletin boards.

It is therefore another object of the present invention to use a new concept in displaying and maintaining messages and bulletins on a bulletin board in that special holders or frames are built into the display itself, so that the use of tacks, nails, glue or other types of securing means are not necessary.

A further object of the present invention is to provide a bulletin board that can be swung to a horizontal position to serve as a table and thereby facilitate a rapid installation and removal of messages or bulletins to be mounted on said bulletin board within transparencies. The end result of inserting the messages and bulletins in the special holders or frames is that each of said messages are snuggly fitted within a transparency of glass or plastic and held therein securely until it is desired to remove the same.

A still further object of the present invention is to provide a card collection box to store and issue message cards for display at a proper preselected time sequence.

It is a further object of the present invention to construct a novel bulletin display board with means for holding and dispensing messages or bulletins for said board, which results in speed in changing any number of display messages, as well as low cost for constructing the same. The bulletin display board further permits a secure maintenance of the display cards or messages against tampering. Furthermore, the display board is pivotable on its support stand so that it is rotatable from a vertical to a substantially horizontal position. The advantage of such an arrangement has been set forth hereinbefore.

Another object of the present invention is to provide a simple, somewhat resilient clip or clamp for holding the transparencies inside the frame of the display board and which permits easy insertion and removal of messages and bulletins.

In order that the invention will be more clearly understood, it will now be disclosed in greater detail with reference to the accompanying drawings, in which.

DESCRIPTION OF THE PREFERRED EMBODIMENT

Figure 1:
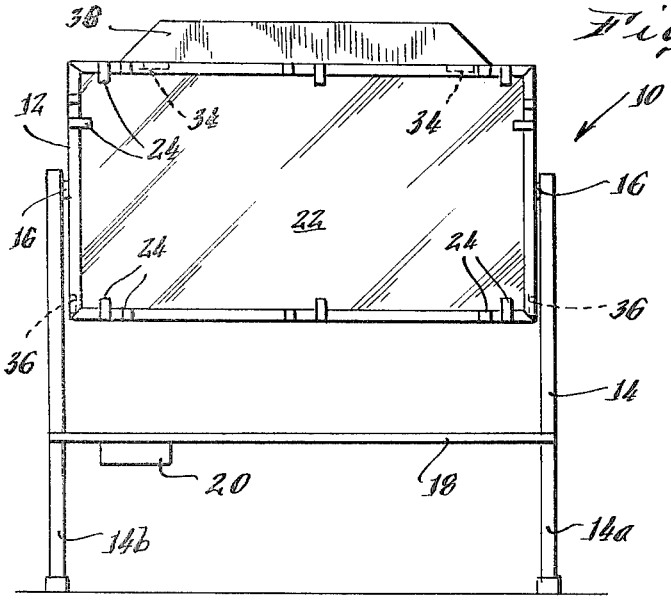
FIG. 1 is a front elevational view of my improved display device assembly having a bulletin display board showing the holders and removable clips for holders, all in accordance with the teachings of my invention.

Referring to FIG. 1, a portable display device assembly having a bulletin display board is shown and referred to generally by the reference numeral 10 which comprises a display board 12 and the support stand 14. The display board 12 is pivotally mounted on the support stand 14 by means of pivots 16 while a cross brace 18 connects the legs **14*a* and 14*b* of the support stand 14. Mounted on the cross brace 18 is a card collector box 20 in which messages or bulletins are stored for use at the appropriate time in connection with the display board 12**.

Figure 2:
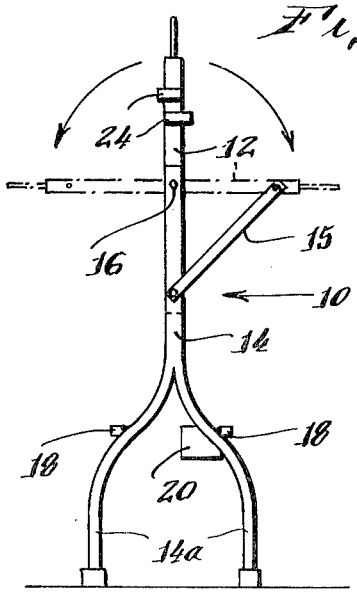
FIG. 2 is a side elevational view of the display device assembly in two positions.
Figure 3:
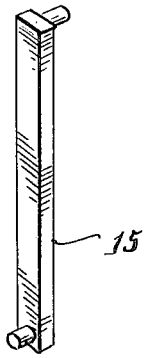
FIG. 3 shows the holding rod in side elevation.

As seen in FIG. 2, the display board 12 can be pivoted from a vertical to a horizontal position and vice versa. However, when the display board is in its horizontal position a rod 15 such as clearly shown in FIG. 3 is provided with one right angle end that is inserted in the support stand 14 while the other right angle end is inserted in the side of the display board in order to hold the latter in a horizontal plane.

It should be noted that the change of the display board from a vertical to a horizontal plane permits the cards, messages or bulletins to be easily inserted on the display board which then becomes a table. It should also be noted that the card collector box 20 is easily accessible, at all times, so that the cards, bulletins and messages 23 can be easily inserted on the display board, while outdated and inappropriate messages and bulletins can be removed and placed in the card collector box, if desired.

Figure 4:
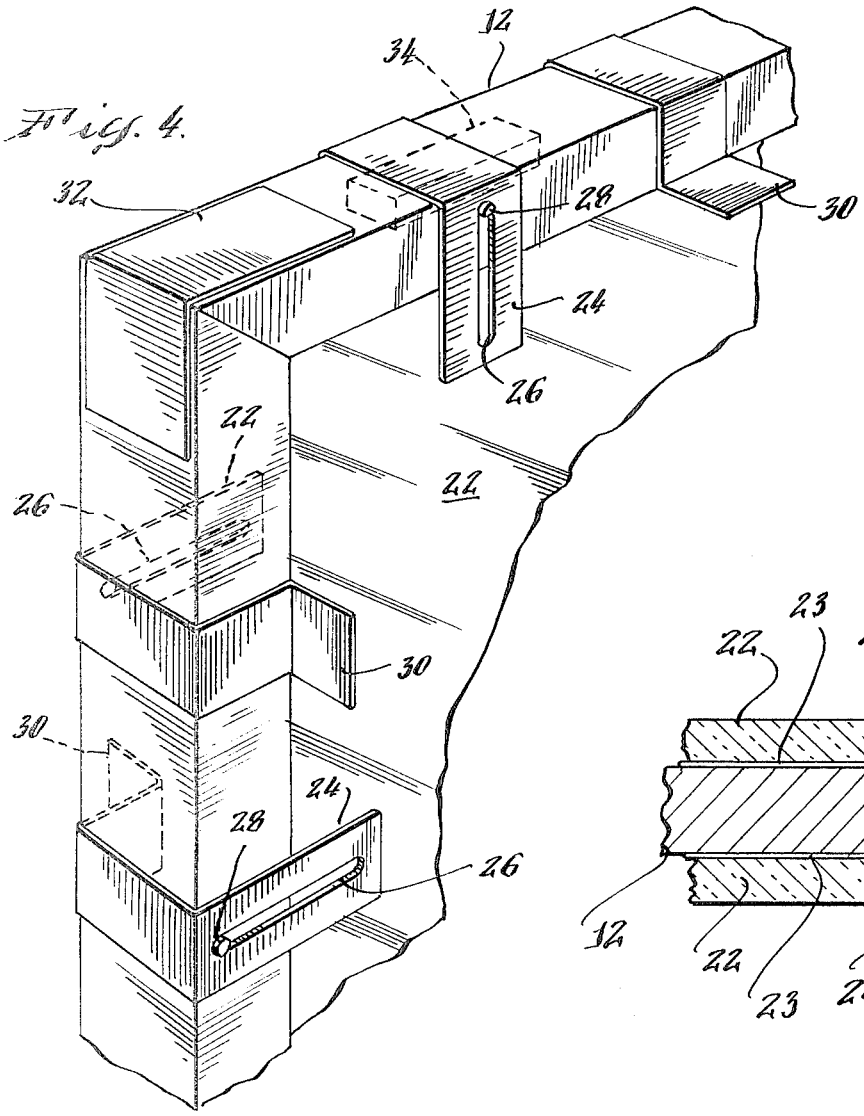
FIG. 4 is a perspective view of an enlarged detail of construction of FIG. 1 showing the clamp in two positions.
Figure 5:
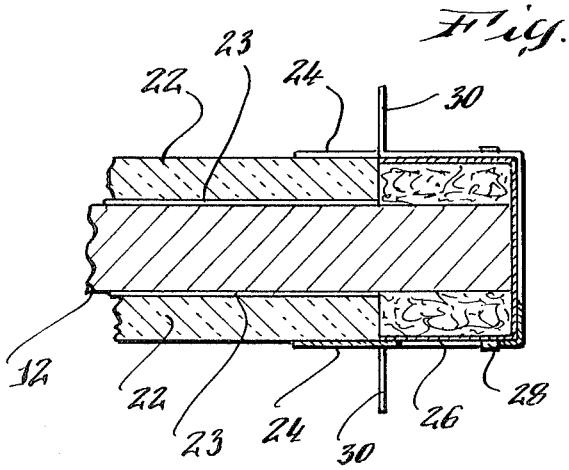
FIG. 5 is a sectional view of a detail of construction of FIG. 4.

Referring to FIGS. 1, 4 and 5, it should be noted that the transparency 22 is fitted within the frame of the bulletin board 12 and takes the form of a shallow tray that is held in position by means of overlapping, spring-like clips 24. As seen in FIG. 4, the clips may be arranged to hold transparencies on either side of the bulletin board 10. For this purpose each of the clips 24 is provided with a slot 26 having a rivet 28 that permanently attaches the clip to the frame, but permits the clip to be slid laterally so that the transparency 22 can be inserted and removed with ease, and without the danger of losing or misplacing the clip. Thus, both sides of the bulletin board can be utilized, if so required. The clips 24 are rigid but relatively resilient, so that the same can be easily inserted and removed, when required, while grasping the projecting end 30 thereof. As stated hereinbefore, the clips do not have to be totally removed from the frame of the display board in order to remove the transparency, but may be pulled part way on the frame to clear the edge of the transparency thereby permitting the latter to be removed, when such is required. Each of the corners of the frame is provided with reinforcing angle brackets 32, one of which is shown in FIG. 4, to thereby strengthen the display board while the two lower corner brackets have permanent magnets 36 which hold the display board firmly in a vertical position due to the magnetic attraction to the adjacent iron legs 14*a* and 14*b* respectively.

The sign 38, which could carry the indicia "Messages", is adapted to be held on the top of the bulletin display board 12 by means of permanent magnets 34, so that the sign can be readily removed, if desired.

It should also be noted that the manufacture of the present billboard can be accomplished from standard materials in a simple manner, and without the use of costly machinery and fixtures. Furthermore, the provision of a horizontal disposition of the bulletin board is important for speed and ease of assembling and mounting messages and bulletins, as well as removing the same.

While the present invention has been disclosed and described with reference to the embodiment shown therein, it will be apparent that variations and modifications may be made therein within the true spirit and scope of said invention.

What is claimed is:

1. A display device assembly having a display board for messages and bulletins comprising a support stand, means pivotally mounting said display board on said support stand whereby said display board can selectively assume substantially vertical and horizontal positions, said display board having a peripheral frame for said display board having a surface projecting above the plane of said display board, a tray-like transparency, a plurality of releasable clips on said frame for holding said transparency on said display board within the confines of said projecting surface of said frame and with said messages and bulletins therebetween, and at least one permanent magnet on a lower corner of said frame, and said support stand being provided with at least one magnetically attracted leg whereby when said display board is in its vertical position said board is maintained in that position by magnetic forces.

2. A display device assembly as claimed in claim 1 further comprising a message collecting box mounted on said support stand for temporarily holding messages to be removably attached to said display board.

3. A display device assembly as claimed in claim 1 further comprising a member having one end removably secured to said support stand and the other end removably secured to said frame whereby said display board is held in a horizontal position.

4. A display device assembly as claimed in claim 1 wherein each of said releasable clips are relatively flexible and provided with a slot in one part thereof, a retaining means in said slot being affixed at one end to said frame whereby said clip is slidable on said retaining means to a position in which said clip is removed from engagement with said transparency.

5. A display device assembly as claimed in claim 1 further provided with reinforcing angle brackets on the corners of said frame.

6. A display device assembly for messages and bulletins comprising a support stand, means pivotally mounting said display board on said support stand whereby said display board can assume substantially vertical and horizontal positions, said display board being provided with a peripheral frame having opposite surfaces raised above the plane of said display board, two tray-like transparencies adapted to fit over the front and rear surfaces of said display board respectively, a plurality of releasable clips facing in opposite directions for holding each transparency on its respective surface of said display board with said messages and bulletins therebetween, and a pair of permanent magnets on the lower corners of said frame, and said support stand being provided with magnetically attracted legs whereby when said display board is in its vertical position said board is maintained in that position by magnetic forces.

7. A display device assembly as claimed in claim 6 further comprising a sign, and magnetic means for removably attaching said sign to said frame.

* * * * *